United States Patent [19]

Tauzin

[11] Patent Number: 4,635,561

[45] Date of Patent: Jan. 13, 1987

[54] CABIN FOR AN AERIAL CABLEWAY

[75] Inventor: Francis Tauzin, Veyrins, France

[73] Assignee: Sigma Plastique and Pomagalski S.A., Fontaine, France

[21] Appl. No.: 671,211

[22] Filed: Nov. 14, 1984

[30] Foreign Application Priority Data

Dec. 16, 1983 [FR] France ..... 83 20329

[51] Int. Cl.[4] ..... B61D 19/00

[52] U.S. Cl. ..... 105/329.1; 105/343; 104/173.2; 49/109; 49/111

[58] Field of Search ..... 105/329 S, 329 SC, 329 R, 105/332, 337, 339, 343, 377, 378; 104/173 ST; 49/109, 110, 111

[56] References Cited

U.S. PATENT DOCUMENTS

| | | | |
|---|---|---|---|
| 3,931,769 | 1/1976 | Tauzin | 105/329 S |
| 3,995,563 | 12/1976 | Blunden | 105/378 |
| 4,149,471 | 4/1979 | Tauzin et al. | 105/329 S |
| 4,327,648 | 5/1982 | Anton | 105/329 S X |
| 4,433,505 | 2/1984 | Viner | 49/110 |
| 4,454,685 | 6/1984 | van der Sloot et al. | 49/110 |

FOREIGN PATENT DOCUMENTS

| | | |
|---|---|---|
| 884865 | 7/1953 | Fed. Rep. of Germany . |
| 1442814 | 5/1966 | France . |
| 2453063 | 4/1979 | France . |
| 2504078 | 4/1981 | France . |

*Primary Examiner*—Robert B. Reeves
*Assistant Examiner*—Glenn B. Foster
*Attorney, Agent, or Firm*—Parkhurst & Oliff

[57] ABSTRACT

A cabin of an aerial cableway having a generally square shape and at least a door opening on the whole lateral wall. The door comprises two panels adapted to abut one another for closing the door opening and to move symmetrically away along a curved path towards the open position. In the open position each panel covers one half face of the end wall. An actuating mechanism includes link rods secured to the roof and to the floor of the cabin for guiding and moving symmetrically the door panels.

4 Claims, 3 Drawing Figures

CABIN FOR AN AERIAL CABLEWAY

The invention relates to a cabin or a car for an aerial cableway.

BACKGROUND OF THE INVENTION

In general the passenger carrying cabin is provided with a sliding door, for instance an automatically operated two panels door. The panels about one another in the closed position and move away from one another to open the door. In the open position the panels protrude on both sides of the cabin end walls and the succeeding cabins must be spaced apart in the stations. Another conventional cabin has two sliding doors adapted to move rectilinearly so as to overlap one another in the open position and to cover a fixed middle panel which hinders the free access to the cabin.

It is an object of the present invention to provide a cableway cabin for a great number of passengers wherein the passenger embarkation and disembarkation are accelerated.

A further object is to provide a cabin wherein the whole lateral wall is arranged as a door opening.

A still further object if to provide an automatic door actuating mechanism for moving the door panel along a substantially circular path.

SUMMARY OF THE INVENTION

In accordance with the present invention there is provided a passenger carrying cabin which comprises a door having two panels adapted to move away towards the open position. In this open position the door panels overlap the cabin end walls and do not increase substantially the cabin sizes. The cabin has a generally parallelepipedical shape, the lateral and end walls extending substantially along the four sides of a square. Each door panel is mounted to an actuating mechanism secured to the roof and to the floor of the cabin. This mechanism includes an actuating lever which engages a control rail extending along the cabin travel path to open or to close automatically the door at the passage of the vehicle. The mechanism comprises a crank and vertically pivoted link rods for moving each door panel along a circular path. An automatic door lock maintains the door panels in the closed position.

BRIEF DESCRIPTION OF THE DRAWINGS

Other advantages and features of the invention will be disclosed by the following exemplary description of an embodiment of the invention, shown in the accompanying drawings wherein.

DETAILED DESCRIPTION OF THE PREFERRED EMBODIMENTS

Figure 1:
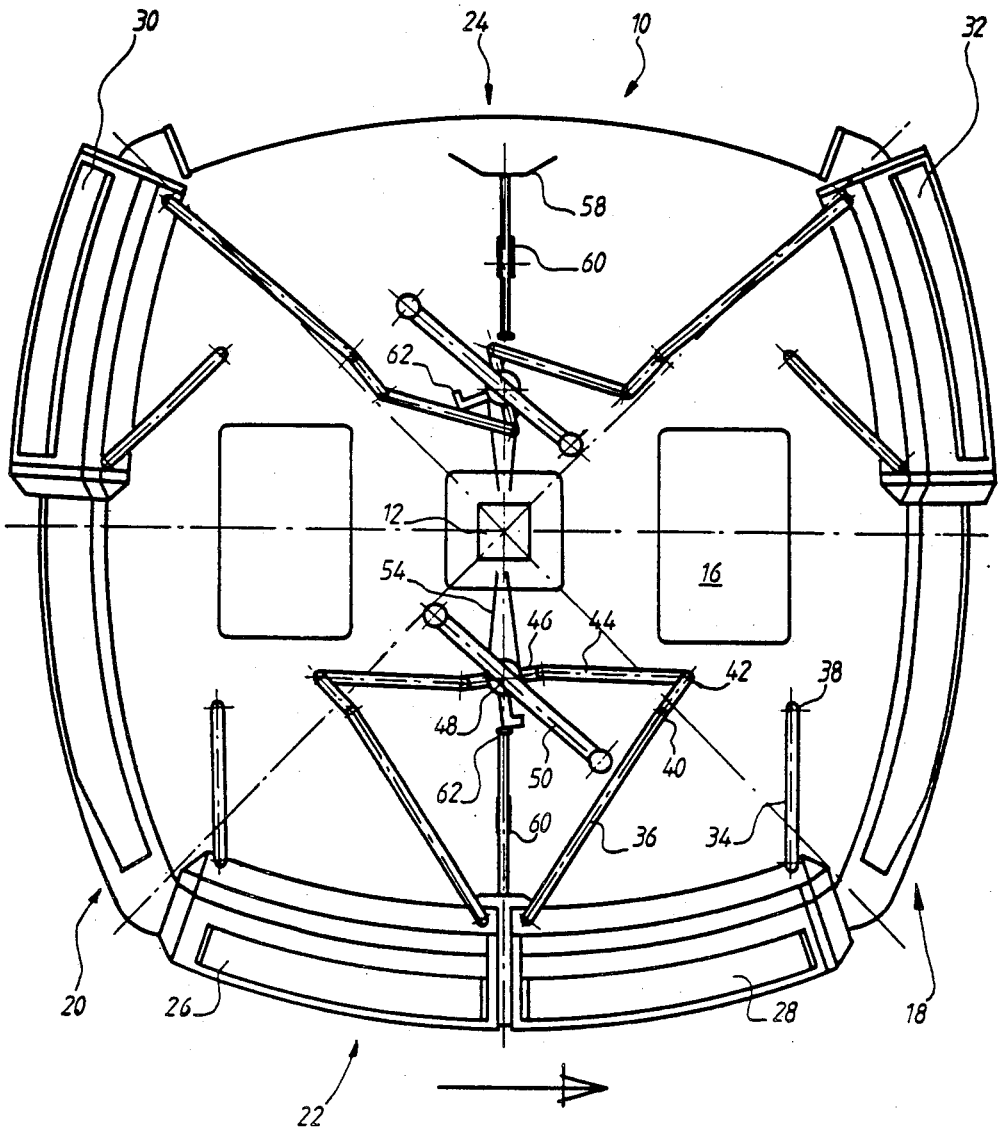
FIG. 1 is a top plan view of a cabin according to the invention, one door being shown open and the other closed.
Figure 2:
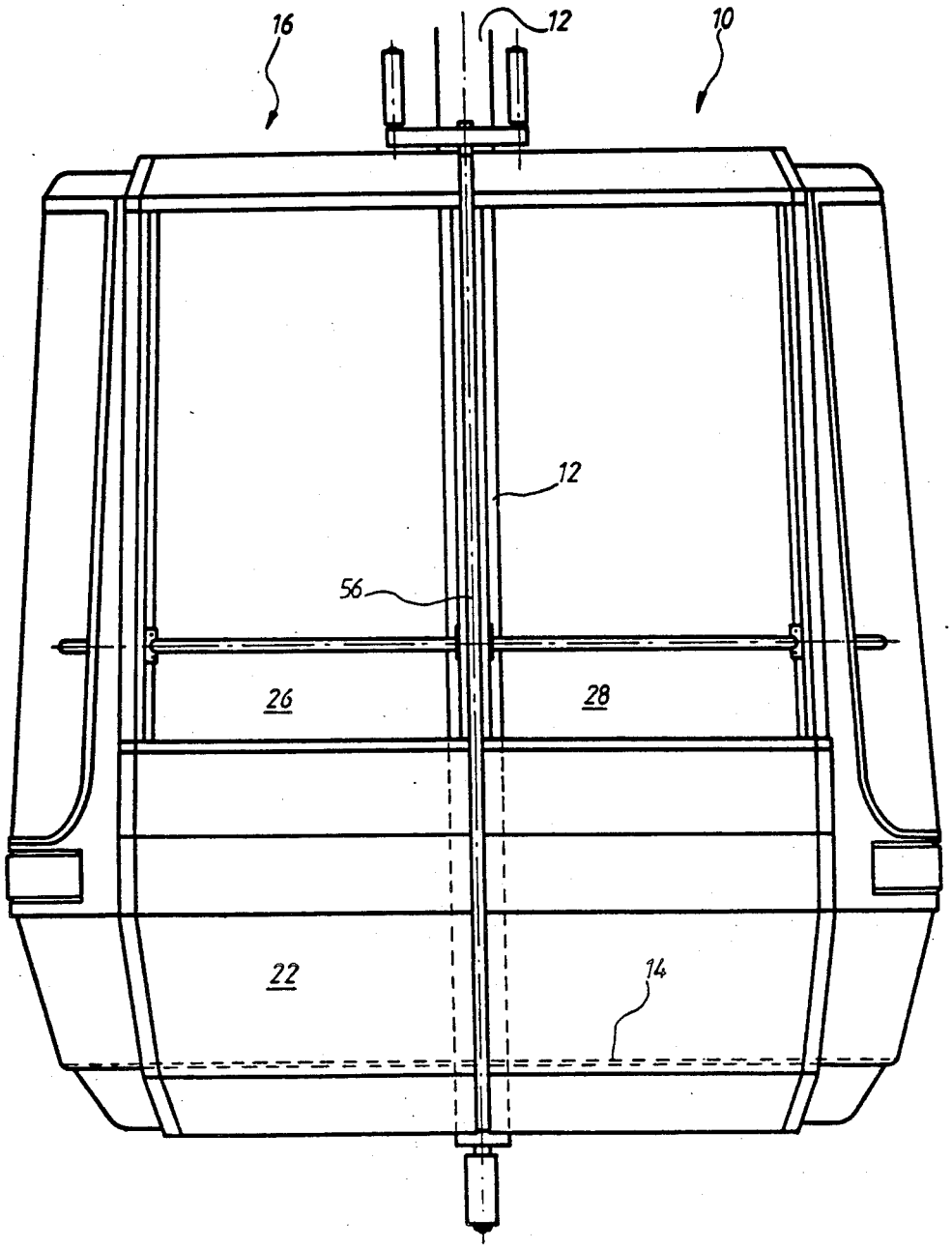
FIG. 2 is a side elevational view of the cabin.
Figure 3:
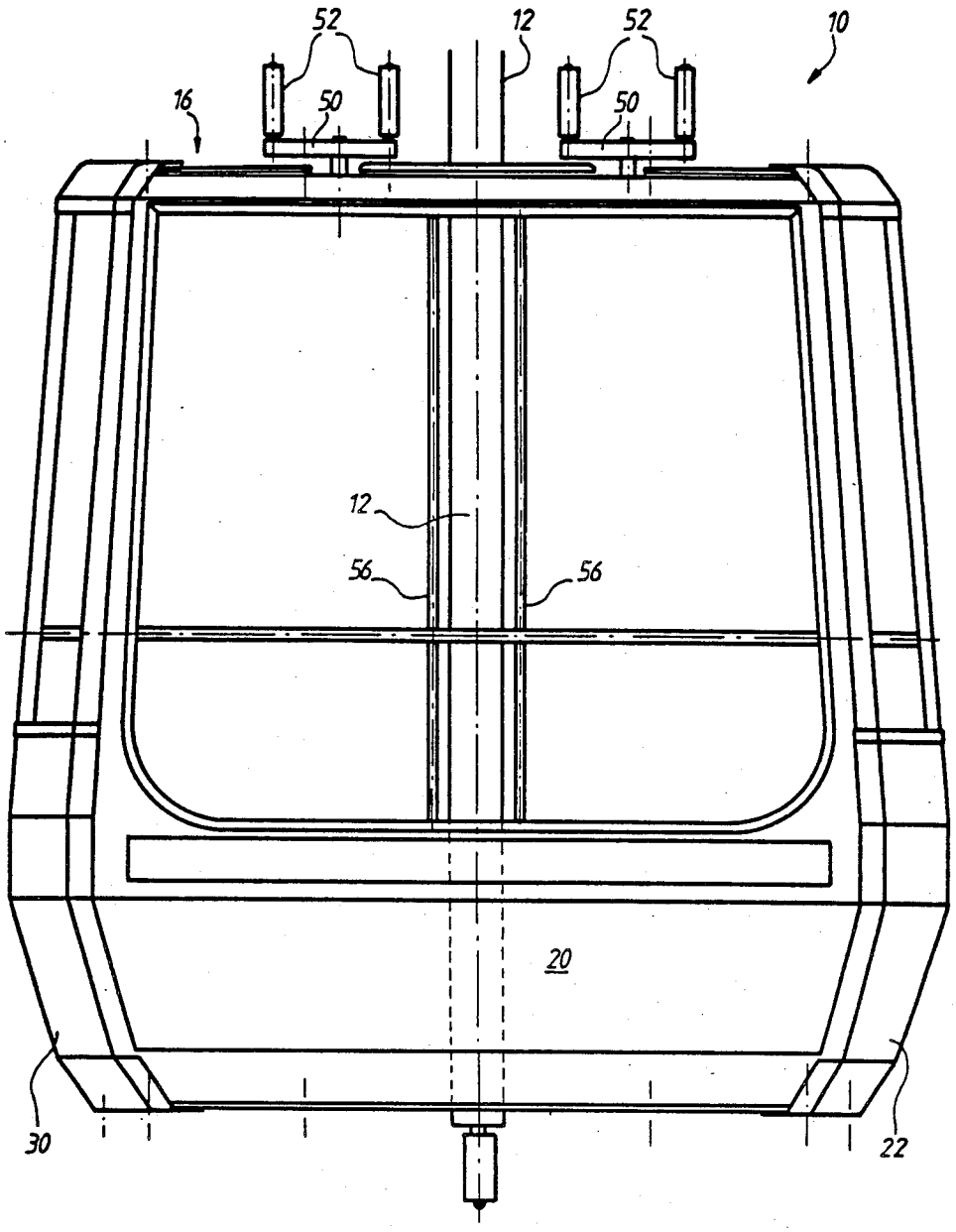
FIG. 3 is an end elevational view of the cabin, the door being closed.

Referring to the drawings a cabin 10 or a car of a passenger cableway is provided with an upwardly extending support rod 12 secured in fixed or detachable manner to the cable (not shown). The cableway may be a monocable or a bicable system for instance a gondola lift or a railway. The cabin includes a floor platform 14, two lateral walls 22, 24 facing each other, two end-walls

18, 20 facing each other and a roof 16. The floor 14 and the roof 16 are rigidly secured to the support rod 12 to form a framework carrying the four walls 18–24. The end-walls 18, 20 are fixed and the lateral walls 22, 24 have each a door along the whole side length of the cabin 10. The four walls 18–24 are disposed substantially along the sides of a square, and each face is slightly curved to increase its solidity and aesthetics. Each door has two door panels 26, 28; 30, 32 adapted to move in opposite directions so as either to abut one another for the closed position of the door or to move away symmetrically from one another to open the door. The panels 26–32 extend along the whole cabin height and each panel is carried by operating mechanisms secured to the floor 14 and to the roof 16. The two operating mechanisms are identical and linked together and only the roof mechanism will be described in detail below more particularly with reference to FIG. 1. Two link rods 34, 36 are respectively hinged on the one hand on spindles 38, 40 rigidly secured to the roof 16 and on the other hand on spindles secured to the rear end and to the front end of the panel 28. The spindles 38, 40 are disposed on the roof 16 so that the panel 28 moves along a circular path from the closed position towards the open position, wherein the panel 28 covers the half face of the cabin end wall 18 in a symmetrically position of the panel 32 position shown in FIG. 1. In the open position of the two doors the panels 28, 32 nearly abut one another, covering the whole front end wall 18, while the panels 26, 30 cover the rear end wall 20. The panels are applied against the end walls and the cabin 10 outside dimensions are not substantially increased by these swinged round panels. As shown in FIG. 1, the link rod 36 comes into an inclined position at the end of the door closing movement so as to shift the panels insides for locking the panels 26, 28 into the door opening. The link rod 36 extends beyond the spindle 40 and its end 42 is connected to a crank 46 by means of a connecting rod 44. The crank 46 is mounted so as to rotate on the roof 16, on a spindle 48 located in the vertical transverse symmetrical cabin plan. It is easily seen that the crank 46 links the connecting rods of the two panels 26, 28 of the door which move symmetrically. The crank 46 carries two control levers 50 having at their end wheels 52 to work to conjuction with control flaps or rails located in the door opening and closing areas in the stations.

The crank 46 on the roof 16 and the associated crank under the platform 14 are connected by a cable 54 or a coupling rod which extends inside a pipe 56 parallel to the support rod 12. The panels 26, 28 are maintained and actuated at their upper and lower sides.

The panels 26, 28; 30, 32 are locked in the closed position by the toggle mechanism formed by the crank 46 and the connecting rod 44 which moves beyond the straight position. Therefor the connecting rod 44 includes an elastic link so as to exert a panel closing force as well as a biasing force of the crank 46 in the direction of an abutment (not shown) beyond the straight position. An obstacle between the two door panels does not hinder the movement of the mechanism towards the closed position, the panels remaining open in abutment with the obstacle. The obstacle being removed the door closes automatically. The mechanism remains in the closed position when the door panels are pushed towards the open position.

The elastic connecting rod 44 allows a crank 46 movement beyond the straight toggle position, the panels 26, 28 being in the closed position and this movement operates a fork shaped latch 58 for locking the closed door panels 26, 28 in that position. The latch 58 is rigidly secured to one end of a movable rod 60, the other end therefrom cooperating with a cam 62 secured to the crank 46 so that the panels are locked at the end of the closing movement and are unlocked before they open. Any other suitable locking system may be used.

The door panels 26–32 and the walls 18, 20 have windows and the two opposite doors permit passenger embarkation and disembarkation on both sides of the cabin. The cabin may have only one door and it may be arranged for twenty passengers or more.

All movements of the door operating mechanism are a rotation and ice or snow cannot hinder the door operating manoeuvres.

I claim:

1. A cabin for an aerial cableway, said cabin having a generally parallelepipedical shape in vertical cross-section and comprising:

a floor and a roof, two lateral walls facing each other, at least one of which has a door opening extending substantially along the whole lateral wall, two end walls facing each other, the lateral walls and the end walls intersecting at junctions and having substantially the same width to form substantially a square in a horizontal cross section, a door having two substantially planar identical panels, each panel having a closing edge and an opening edge opposite said closing edge, said closing edges of said panels contact each other when the panels are in a closed position such that said panels cover said door opening, said panels move symmetrically away from each other to effect opening of the door, a door actuating mechanism having a set of first and second link rods for each panel, a first link rod having an outboard end pivotally mounted adjacent the closing edge of one panel and an opposite inboard end of said first link rod pivotally mounted on a first fixed vertical axis, and a second link rod having an outboard end pivotally mounted adjacant the opening edge of said one panel and an opposite inboard end of said second link rod pivotally mounted on a second vertical fixed axis, said first and second axes being located such that said second axis is arranged closer to said end wall than said first axis so that actuating the link rods guides the panel along a curved travel path around the junction between the end wall and side wall of the cabin, the panel in the open position being disposed close to and in parallel relationship with the end wall and covering about one half of the end wall, the opening edge of said panel being adjacent said junction between end wall and lateral wall.

2. A cabin according to claim 1, having a door opening on each lateral wall wherein the opening edges of the panels of the doors facing each other in the closed position on opposite lateral walls are adapted to move so as to substantially contact each other in the open position and substantially cover the entire end wall.

3. A cabin according to claim 1, wherein said set of first and second link rods are located on said roof and said door actuating mechanism includes an additional set of corresponding first and second link rods located beneath said floor, said cabin further comprising, a connecting link extending between the roof and the floor to connect said sets of first and second rods for a symmetrical movement.

4. A cabin according to claim 1, having a crank and two crank levers, one crank lever being linked to the first link rod of one panel of the door and the other crank lever being linked to the first link rod of the other panel of the door so as to move the two panels of the door symmetrically.

* * * * *